US005257196A

United States Patent [19]

Sansone

[11] Patent Number: 5,257,196

[45] Date of Patent: Oct. 26, 1993

[54] APPARATUS AND METHOD FOR THE PROCESSING OF MAIL

[75] Inventor: Ronald P. Sansone, Weston, Conn.

[73] Assignee: Pitney Bowes Inc., Stamford, Conn.

[21] Appl. No.: 282,713

[22] Filed: Dec. 13, 1988

[51] Int. Cl.[5] ..... G07B 17/02

[52] U.S. Cl. ..... 364/464.02

[58] Field of Search ..... 364/464.02, 464.03

[56] References Cited

U.S. PATENT DOCUMENTS

| | | | |
|---|---|---|---|
| 4,097,923 | 6/1978 | Eckert, Jr. et al. | 364/900 |
| 4,253,158 | 2/1981 | McFiggans | 364/900 |
| 4,511,793 | 4/1985 | Racanelli | 235/375 |
| 4,569,022 | 2/1986 | Coppola et al. | 364/464.03 |
| 4,713,761 | 12/1987 | Sharpe et al. | 364/406 |
| 4,752,950 | 6/1988 | Le Carpentier | 364/464.02 X |
| 4,760,534 | 7/1988 | Fougere et al. | 364/464.03 X |
| 4,787,046 | 11/1988 | Feinland et al. | 364/464.03 |
| 4,821,195 | 4/1989 | Baer et al. | 364/464.02 |
| 4,831,555 | 5/1989 | Sansone et al. | 364/464.02 X |
| 4,837,701 | 6/1989 | Sansone et al. | 364/464.03 |
| 4,849,884 | 7/1989 | Axelrod et al. | 364/464.02 X |
| 4,853,864 | 8/1989 | Hart et al. | 364/464.02 |
| 4,858,138 | 8/1989 | Talmandge | 364/464.02 |

*Primary Examiner*—Edward R. Cosimano

*Attorney, Agent, or Firm*—Peter Vrahotes; Melvin J. Scolnick

[57] ABSTRACT

A system has been conceived whereby the capability of a postage meter can be expanded through use of an interface device. A device is put into electrical communication with an electronic postage meter, and this device in turn is connected to a number of other devices. The other devices can include a computer, a printer, a scale, and the like, whereby mail may be processed, the postage required to mail such mail pieces accumulated, and the final amount of postage required to mail a batch of mail communicated to the postage meter. The postage meter would then print an indicia either upon a tape or upon a statement sheet thereby providing the required postage for accompaniment with a batch of mail.

3 Claims, 3 Drawing Sheets

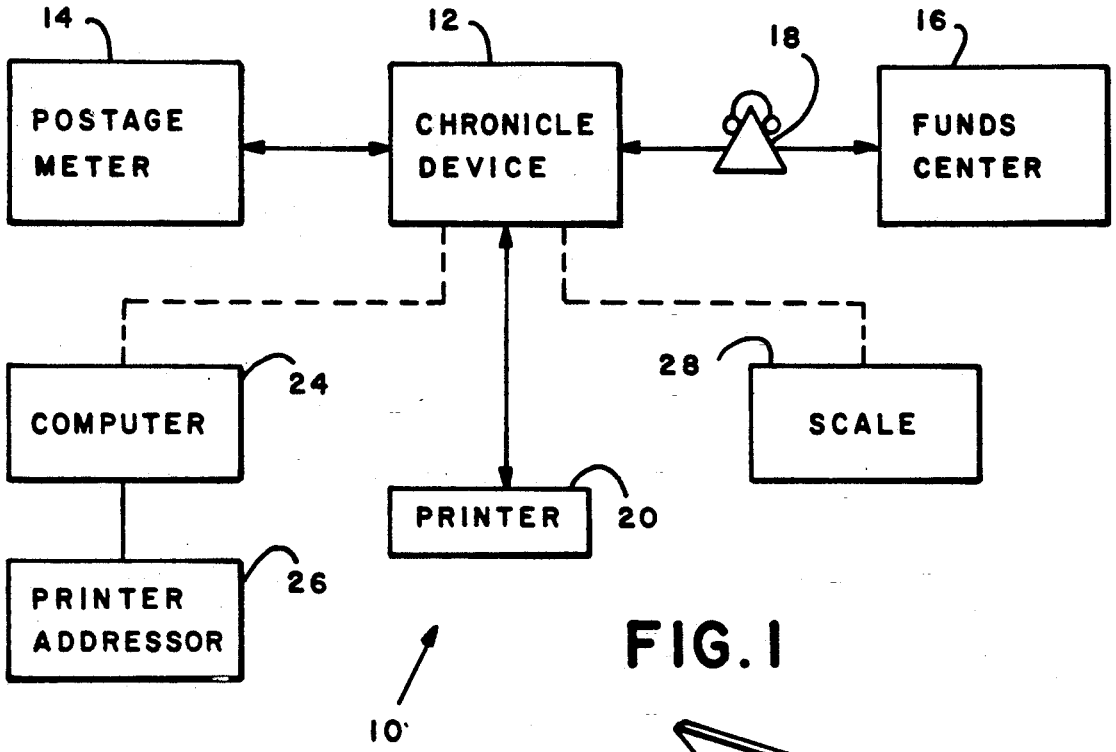
FIG. 1
FIG. 2
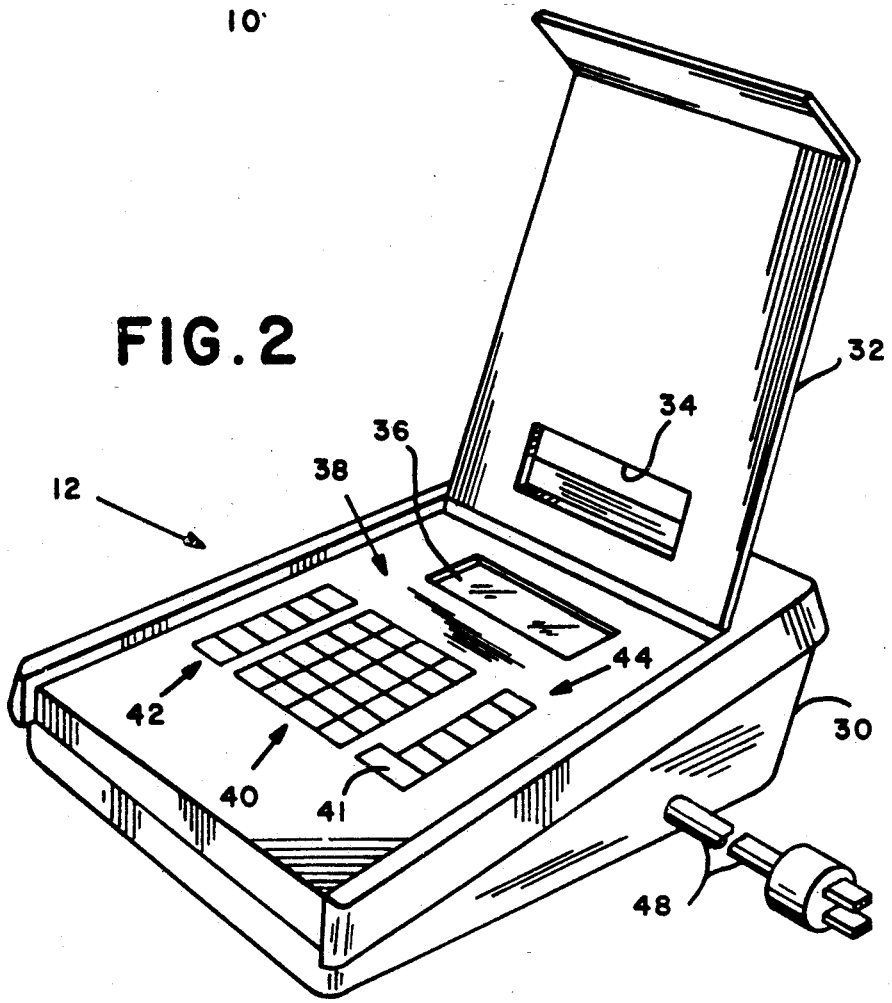

FIG. 5

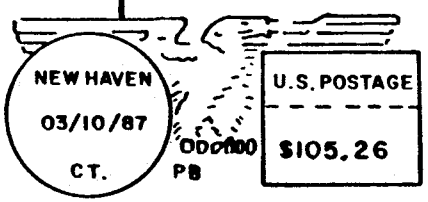

132

STATEMENT SHEET

PERMIT NUMBER: -------

MAILER: NAME
ADDRESS
CITY, STATE, ZIP
TELEPHONE

136

AUTH: 9WIBNJ 2D 56RX8Z CZV75A
HNSYC2 LB674X 1B 69M795 T068L7
BAAZ64 QA6135 WW TT5MGM YOMAT2
L2P7YN YXBRXK NX RT81XS KJJOA7

138

DATE PREPARED: 03/10/87
COPY NUMBER: 1

140

BEGINNING SERIAL # 1
ENDING SERIAL # 364
TOTAL PIECES 364
METER # 3602 0001004

USPS ENTRY POINT: NEW HAVEN
MAILING DATE: 03/10/87

141

BEGINNING BALANCE $90592.640
TOTAL ADDITIONS $ 0.000
POSTAGE USED $ 105.260
ENDING BALANCE $90487.380

144

POSTAGE COMPUTATION — FIRST CLASS, LETTERS — RATE REV: 08/20/86

| WEIGHT CLASS | ------1 OZ------ | | ------2 OZ------ | | ------3 OZ------ | | ------TOTAL----- | | ADDITIONAL POSTAGE - ADJUSTMENT FOR - - NON-QUALIFIERS - | |
|---|---|---|---|---|---|---|---|---|---|---|
| RATE CLASS | # PCS | $ AMT | # PCS | $ AMT | # PCS | $ AMT | # PCS | $ AMT | # PCS | $ AMT |
| FN 1ST CLASS NON-PRESORT | 0 | 0.000 | 0 | 0.000 | 0 | 0.000 | 0 | 0.000 | | |
| ZN ZIP + 4 NON-PRESORT | 0 | 0.000 | 0 | 0.000 | 0 | 0.000 | 0 | 0.000 | 0 | 0.000 |
| FP 1ST CLASS PRESORT | 0 | 0.000 | 64 | 22.400 | 0 | 0.000 | 64 | 22.400 | 64 | 2.560 |
| CP CARRIER RTE PRESORT | 0 | 0.000 | 0 | 0.000 | 0 | 0.000 | 0 | 0.000 | 0 | 0.000 |
| ZP ZIP + 4 PRESORT | 200 | 35.000 | 100 | 34.500 | 0 | 0.000 | 300 | 69.500 | 300 | 10.800 |
| SUBTOTALS | 200 | 35.000 | 164 | 56.900 | 0 | 0.000 | 364 | 91.900 | 364 | 13.360 |

142

APPARATUS AND METHOD FOR THE PROCESSING OF MAIL

BACKGROUND OF THE INVENTION

Certain organizations dispatch large amounts of mail, usually on a periodic schedule. Examples of such organizations are: banks, utility companies, insurance companies, credit companies and the like. With such large quantities, these mailers normally prepackage and presort their mail and as a result are given discounted postage rates by the Postal Service because of the time saved at the Post Office. There are generally two ways in which such mail senders apply postage to their mail. The more common way is by use of a postage meter which is leased by the mail sender from a postage meter manufacturer with which the amount of postage required is applied to each mail piece. Inserter systems have been developed whereby inserts can be placed into an envelope, the envelope sealed, and a postage indicia applied thereto. The mail pieces may be weighed during processing or individual weighing may not be required if all the mail pieces are of like kind, i.e., only a sample mail piece need be weighed, to establish the cost for mailing the mail pieces. These acts of processing mail may be performed at a relatively high rate of speed.

The second method of payment for mailing large quantities of mail pieces is the permit mail system. In such a system, the mail sender places a permit indicia on the mail pieces and prepares a manifest listing that itemizes the type and number of mail pieces being mailed on each occasion and the postage required to mail such mail pieces.

Although both systems work well, each has its particular drawbacks. In the case of postage meters, when large quantities of mail pieces are processed, each of which receives an indicia stamped thereon, there is considerable wear on the postage meters and they must be replaced frequently. Because of the requirement for strict security, postage meters are expensive devices. Furthermore, because of the need for strict security, a postage meter does not have flexibility in terms of communicating with other devices such as printers, personal computers, inserters and the like. Having such multiple access to the postage meter would provide too great an opportunity for the commitment of fraud.

With regard to permit mail, the major drawback to this system is that frequent inspection is required on the part of the Postal Service. The individual pieces of mail do not have postage imprinted directly thereupon and a system must be established whereby an accounting can be made for all the mail pieces. This is normally accomplished through the use of a manifest statement that states the amount and type of postage being mailed, and the quantity of mail is checked relative to this manifest. Obviously, one of the concerns is that of the mailer in preparing his manifest statement will understate the amount of mail pieces. Also, the Post Office must rely upon an accounting system or the credit worthiness of the mailer to secure payment for the mail.

In view of the above, it would be desirable to establish a system whereby the mail pieces are accompanied by proof of payment of postage that is directly associated with a batch of mail, which system would save the Post office time while providing the flexibility to a mailer that is required under the present business climate.

SUMMARY OF THE INVENTION

A system has been conceived whereby a versatile device communicates with a postage meter for the purpose of having the postage meter produce a representation of a stated amount of postage, i.e. a postage indicia, either on a general tape or upon a manifest sheet. The device serves the function of linking the postage meter to functional units. The device can be in communication with a printer, a scale, a personal computer, and other components that are involved in the processing of mail. The unique device would chronicle the amount of postage required to mail a batch of mail, the number of mail pieces processed, the class of mail, and any other information that is required. After a batch of mail is processed by the mailer and is ready to be sent to the Post Office, the unique device would communicate with a postage meter to cause the postage meter to print a postage indicia either upon a gummed tape or upon a statement sheet, or manifest. If the indicia is printed upon a tape, the postage would be attached to a statement sheet that would accompany the batch of mail to the Post Office. If the postage indicia is printed directly upon the statement sheet, obviously, this would also accompany the batch of mail to the Post Office acceptance unit.

Upon receipt of the batch of mail with a statement sheet containing a postage meter indicia thereon, the postal clerk at the acceptance unit has direct evidence that the postage has been paid to the same extent as when be examines a mail piece with a postage indicia thereon. The only requirement thereafter is that a determination of the number of mail pieces be correct, and this can be done with modern equipment through mail processing machines used by the Post Office, such as an optical character reader channel sorter.

The device of this invention also has utility in combination with a postage meter that prints postage indicia upon individual envelopes. It would serve as a more convenient means for refreshing the descending register of the postage meter and would connect the postage meter to other devices.

BRIEF DESCRIPTION OF THE DRAWINGS

FIG. 1 is a block diagram that shows an accounting system for batch mail whereby a postage indicia may accompany the mail;

FIG. 2 is a perspective view of a chronicle device shown in FIG. 1 and used to monitor mail piece processing;

FIG. 5 is a plan view of a manifest sheet completed in accordance with the principles of the instant invention.

DETAILED DESCRIPTION OF THE PREFERRED EMBODIMENTS

Figure 3:
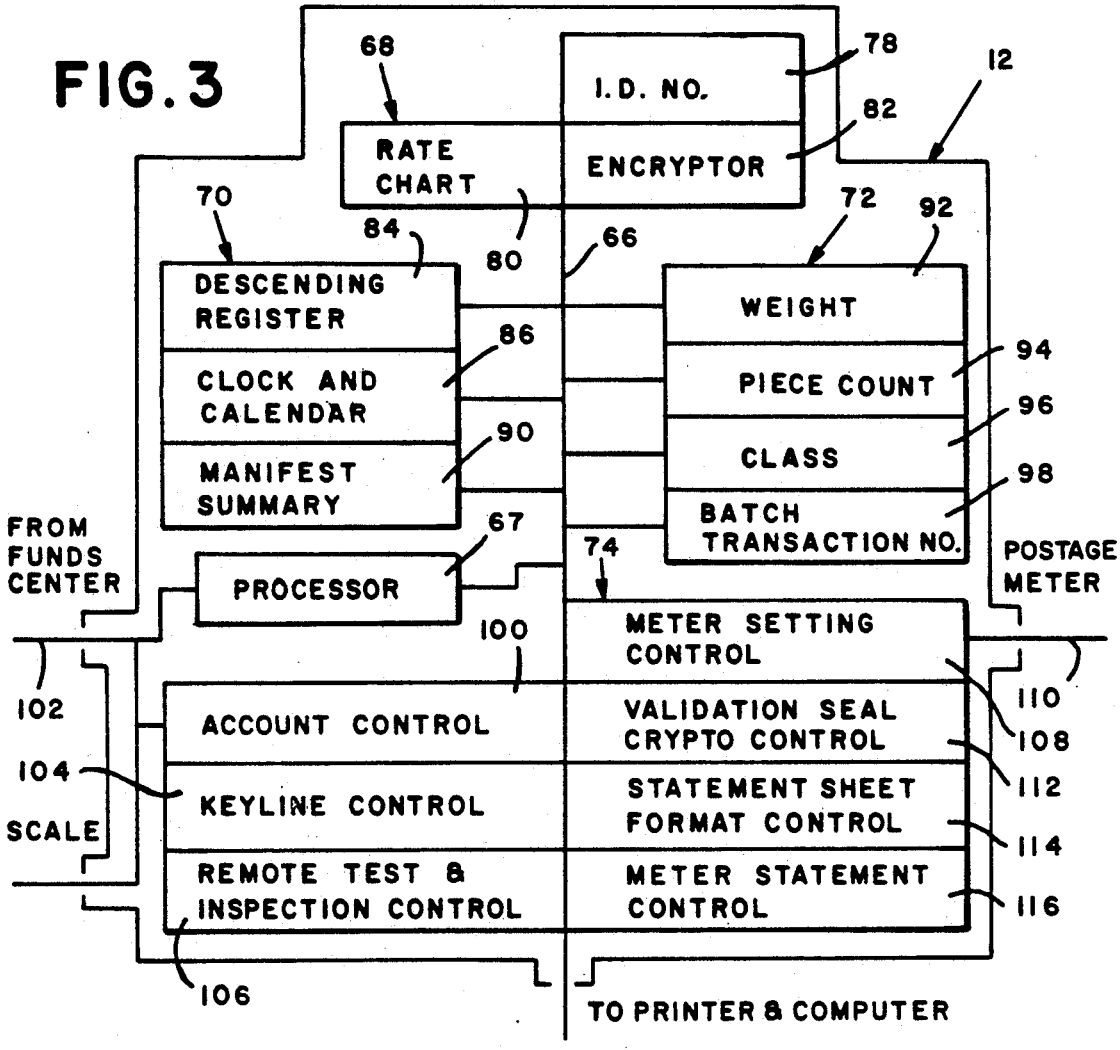
FIG. 3 is a functional diagram of the components of the chronicle device shown in FIG. 2.

Referring now to FIG. 1, a block diagram is shown generally at 10 of a system whereby postage can accompany a batch of mail without each mail piece being printed with a postage indicia, and the descending register of a postage meter can be either refreshed or read. The unit includes a unique device 12 which hereinafter will be called a chronicle device. The term chronicle device is defined as a device that receives, accumulates, and transfers data and communicates with units for performing functions such as reporting functions and postage funds transfer. This chronicle device 12 is in communication with an electronic postage meter 14, such as a Model 6500 postage meters available from Pitney Bowes Inc., through the input/out (I/O) port of the postage meter that normally communicates with a funds center. Communication with a postage meter through the I/O port requires a protocol. For a description of such protocol, reference is made to the U.S. Pat. No. 4,253,158 entitled System for Securing Postage Printing Transactions, and issued to R. B. McFiggins. The chronicle device 12 is also in communication with a funds center 16 that is capable of dispensing postage funds. The manner in which postage funds can be transferred, i.e. a descending register of a postage meter is refreshed, is described in U.S. Pat. No. 4,097,0123 entitled Remote Postage Charging System Using An Advanced Postage Meter, and issued to A. B. Eckert, Jr. et al. The particular connection can be selectively through a telephone 18 and appropriate modems (not shown) or through other communication devices such as a null modem. With such connection, an operator is able to input data through the keyboard of the chronicle device 12 so as to directly communicate with the funds center 16 as will hereinafter be described in more detail.

The chronicle device 12 communicates with a printer 20 and with an addressor 26. Optionally, the chronicle device can communicate with a computer 24 and scale 28.

Referring now to FIG. 2, the chronicle device 12 includes an unsecured housing 30 that contains the electronics required to perform the functions shown in FIG. 3. A lid 32 is pivotally mounted upon the housing 30. The lid 32 has a window 34 therein that is in registration with a display 36 when the lid 32 is lowered, i.e. in contact with the housing 30. The chronicle device 12 has a keyboard 38 consisting of various keys, a central group of keys 40, and two adjacent sets of keys 42,44. The central group of keys 40 are alpha-numeric keys and the like whereas the side keys 42,44 can be special function keys. The lower key 41, on one set of keys 44, is an on/off switch. Power is supplied to the chronicle device 12 through a standard electrical cord 48. Optionally, the chronicle device 12 can be powered by the postage meter or through the telephone line.

Referring now to FIG. 3, the various components and their functions of the chronicle unit 12 circuitry will be described. It should be noted at the outset that the chronicle device 12 is unsecured, i.e. access to the components is not prevented as in the case of a postage meter. A secure housing is not required for the chronicle device since postage funds are not stored therein. Only a representation of the postage funds stored within a postage meter is contained in the chronicle device as will be described hereinafter. The device 12 contains a central bus 66, a processor 67 such as an Intel 8086 processor and a plurality of chips that are in communication with the bus. These chips include a ROM 68, two RAMs 70,72 and another ROM 74. Preferably, the ROMs will be EEPROMS's. The first ROM 68 includes an address cell 78 that stores the identification number of the chronicle device unit 12. A second address 80, contains a postal rate chart whereby the amount of postage required for mail can be determined in conjunction with the weight of the mail, the class and the destination. The last address 82 of the ROM 68 is an encryption register that contains the program required to produce an encryption number based upon data input thereto. The encryption can be based upon the Bureau of Standards Data Encryption Standard (DES).

The first RAM 70 contains a descending register address 84. Preferably, the RAM 70 is a non-volatile RAM or has battery power back-up so that, upon loss of power to the chronicle device unit 12, data contained in the RAM 70 will not be lost. The descending register 84 is intended to replicate the data contained within the descending register of the electronic postage meter 14 after each run as will hereinafter be described. It should be noted that the data stored in the descending register 84 does not represent postage funds, such postage funds representation only being contained within the electronic postage meter 14 descending register. Another address 86 contains a clock-calendar that maintain the correct time of day and date. The last address 90 of the RAM 70 includes data that represents a summary of information contained within statement sheets as will be described hereinafter.

The second RAM 72 includes an address 92 that temporarily stores the weight of a particular mail piece being processed, an address 94 that tracks the piece count for the number of pieces being processed and accumulates batch sub-totals, an address 96 that stores the class of mail being processed, and lastly, an address 98 that includes the transaction number of the particular batch being mailed.

The ROM 74 includes an account control address 100 which is in communication with the fund center 16 through a line 102. The account control address 100 is the portion of the ROM 74 that contains the program for communicating funds information with the postage meter 14. This account control address 100 will forward the funds information resulting from communication with the funds center 16 to a meter setting control address 108 which contains the program for entering the proper protocol for communication with the postage meter 14 through a line 110 so that the descending register of the postage meter can be refreshed with additional postage funds. Another address contains the key line control 104 that supplies the information for the key line 126 (see FIG. 4) which will be described hereinafter; an address 106 contains the program required for remote tests and inspection control when enabled; an address 112 provides a program for encrypting data to supply the encryption required to produce a validation seal 138 as shown in FIG. 5; another address 114 controls formatting of a statement sheet 132 (see FIG. 5); the last address 116 contains a program for preparing a postage statement such as a postal service form 3602. The functions of the various addresses will be described hereinafter in greater detail in conjunction with the operation of the system 10.

Figure 4:
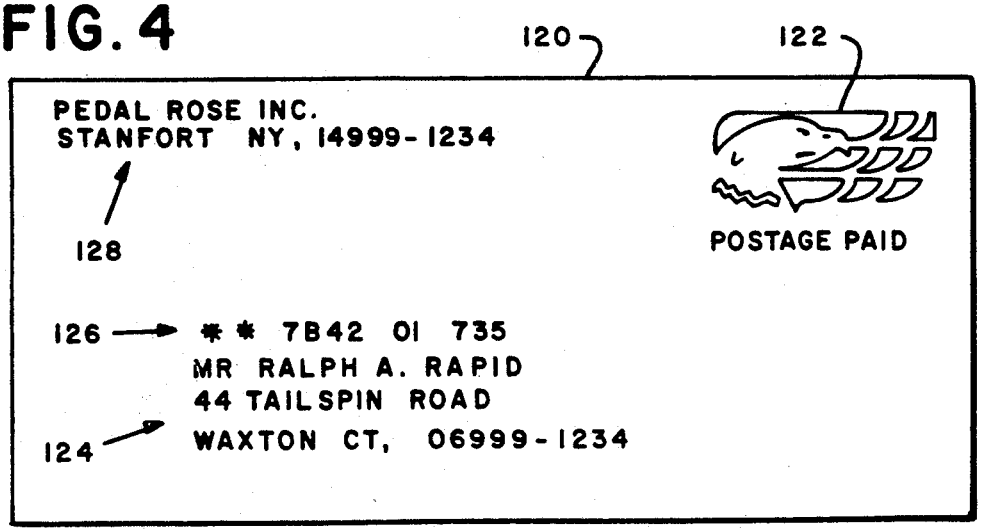
FIG. 4 is a plan view of an envelope that has been processed in accordance with the instant invention.

Referring now to FIG. 4, a mail piece 120, in the form of a non-windowed envelope, is shown with a preprinted indicia 122 in the upper right hand corner as is the normal practice in permit mail. The address block 124 contains the name and address of the recipient of the mail piece, and the key line 126 is shown immediately above the address block 124. The key line 126 serves the function of providing information to the Post office in encrypted form so that the Post Office may obtain appropriate information such as the identification of the mailer, the amount of funds in the mailers postage meter, the postage meter number and the like. Lastly, in the upper left hand corner 128 of the mail piece 120 is the return address of the mailer.

Referring now to FIG. 5, a statement sheet is shown at 132 and contains thereon a postage indicia 134 that is printed by the postage meter 14. This postage indicia 134 can either be printed directly upon the statement sheet 132 by the postage meter 14 or it can be in the form of a gummed tape having an indicia printed thereon that is attached to the statement sheet. The statement sheet 132 contains a block 136 that identifies the mailer by permit number, name and address. A validation seal 138 is contained on the statement sheet, the validation seal being an encrypted combination whereby authenticity of the statement sheet can be determined by decryption thereof. Another block 140 contains information relative to the number of mail pieces that have been processed. Adjacent to block 140 is a block 141 that contains a summary of the postage funds amount available in the descending register of the mail sender's postage meter before the particular transaction, the amount of a particular transaction and the remaining balance after the transaction. A bar code 144 can also be included that would allow fast reading of data summarized for the benefit of the Post Office and contained on a statement sheet. Block 142 shows the weight, class, the rate class, number of mail pieces, and details of postage required to mail such mail pieces. The statement sheet 132 will not be described in any further detail since their contents are generally known.

In operation, the chronicle device 12 is placed into communication with a postage meter 14. This communication will involve a type of protocol wherein encoded communication is used to gain access to the postage meter. This communication is a one way communication whereby funds may be placed into the postage meter, as will described hereinafter, but funds cannot be removed therefrom by the chronicle device 12 except to transfer postage funds to the funds center 16. The device unit 12 also is in selective communication with the funds center 16 by means of a telephone 18, including modems (not shown), or by any other convenient means, such as twisted cables, whereby direct communication can be had between the two units.

One function served by the device is that of refreshing the descending register of the postage meter 14. This is accomplished by the operator inputting through the keyboard 38 appropriate protocol information so that communication between the funds center 16 and the device 12 is established. Upon communication being established, sufficient information to identify to the funds center 16 the particular postage meter 14 to which postage funds are to be transferred will be communicated. After proper identification has been established, the device 12 will indicate to the funds center 16 the amount of postage to be purchased for the refreshment of the descending register in the postage meter 14. The funds center 16 will send the device 12 an encrypted number which when forwarded to the postage meter will refresh the descending register thereof. The device 12 will receive this encrypted number which will appear on its display 36 and which can be stored in the account control address 100. The device 12 will then open communication with the postage meter by means of a prearranged protocol and then forward through the meter setting control address 108 the encrypted number received from the funds center 16 to the postage meter 14 thereby causing the amount of postage to be added to the balance contained in the descending register of such postage meter. The amount of postage stored in the descending register of the postage meter will be stored in the descending register cell 84 for informational purposes in operating the system 10.

The device 12 is connected to the printer 20 that prints data upon a statement sheet 132 under control of the format control address 114 and in conjunction with the ROM 72. This printer 20 can also print meter refill receipts, individual transaction receipts, meter inspection summary data and periodic accounting statements that will summarize a number of transactions under control of the appropriate addresses of the RAM 74.

In a situation where a small number of mail pieces is to be mailed, as for example, between 30 and 200 mail pieces, the operator would cause the appropriate information to be printed upon the mail piece 120 by supplying the information through the keyboard 38 or through a computer 24. The information that would supplied manually through the keyboard 38 or through the computer 24 would be the weight of the mail pieces, the class, the number of pieces to be mailed, the statement sheet 132 number, and other appropriate information. The device 12 would cause such information to be printed upon a statement sheet 132. As stated, this information would include the number of pieces being mailed, which would be placed in block 140, the postage accounting, that would be placed in block 141, the date prepared, the number of mail pieces, and the rate class breakdown, as required in block 142. Upon completion of a statement sheet 132, the amount of postage required to mail the mail pieces 120 would be communicated from the device 12 to the postage meter 14 through a prearranged combination of keys 40. The postage meter 14 will then print the required amount of postage and subtract this amount from its descending register as a normal in the operation of a postage meter. If the postage meter 14 is a reciprocating type postage, meter such as a Pitney Bowes Model 6900 postage meter, the indicia can be printed directly upon the statement sheet. If the postage meter is a rotary type such as a Pitney Bowes Model 6500 postage meter, the postage indicia could be printed upon a gummed tape and the tape could be attached to the statement sheet at 134. With the postage attached thereon, the mail pieces are bundled, and the statement sheet 132 accompanies the batch of mail as it is sent to the Post Office. Because the mail is received at the Post Office with direct evidence of postage having been paid, the Postal Clerk is assured that the mail is authorized. His only requirement at that point is to assure that the number of mail pieces and weight thereof is correct, the latter requirement being the same for all mail. By direct payment of postage is meant that the evidence of postage payment directly accompanies the mail pieces just the same as a single mail piece having a stamp or postage indicia thereon. Thus, this system incorporates all the security features that have been developed through the years for postage meters.

In a situation where large quantities of mail are to be processed that have various weights and classes, additional processing components may be attached to the device 12. These would include a computer 24 that has an addressor 26 attached thereto that prints addresses upon non-windowed envelopes, and a scale 28. It will be appreciated that the addressor 26 and scale 28 may be part of a single mailing machine without departing from the scope of the invention. The computer 24 would have mailing lists stored therein for the completion of the address blocks 124 of each mail piece 120. This information would be supplied to the addressor 26 that would apply the address on the various mail pieces. Alternatively, the addressor 26 could be an inserter, such as an 8300 series inserting system available from Pitney Bowes Inc., or any other type of automatic device that processes mail pieces. Obviously, when the addressor 26 is in the form of an inserter the address will be printed on facing inserts and inserted, with other inserts, into a windowed envelope with the address exposed. After the particular run is complete, the information such as the number of mail pieces, class of mail pieces, and the like are communicated to the chronicle device 12. In conjunction with this, during the processing of the mail, the weight of each mail piece, if required, would be determined by the scale 28 and the appropriate information conveyed to the weight address 92 of the RAM 72. After this information is stored in the various addresses of the device 12, when a run is completed, the information will be forwarded to the processor 67, or, alternatively to the computer 24, and the processor will make a determination of the amount of postage required for the total mail pieces. This determination will then be forwarded to the account control address 100 of the device 12 and, upon an accounting having taken place, the data will be transmitted to the printer 20 which will print the data upon a statement sheet 132. Additionally, the data in the validation control 112 will be computed and sent to the printer 20 to print the validation block 138. With such printing, the amount of postage is subtracted from the descending register address 84 and this amount of postage is forwarded through the meter setting control address 108 to the postage meter 14 as described previously. Once more, the postage indicia would be attached to the statement sheet 132 to indicate direct payment of mail and the descending register of the postage meter will be decremented to account for the postage.

What has been shown and described is a system and method whereby one is able to provide the Post office with direct evidence of postage having been paid for a particular batch of mail. Because the postage meter only prints one indicia for a batch of mail, as opposed to printing on each mail piece, considerable wear is saved on the relatively expensive postage meter. In addition, this is accomplished through a device 12 that has more functions than a commercial postage meter and yet is able to function in coordination with an electronic postage meter to thereby indirectly impart the security features inherent in a postage meter. Further, the effort required on the part of the mailer is reduced substantially because of the ability to control operation of a number of operating units through a keyboard 38 of the device 12.

Mailings with Permit Imprints (145.5)

145.51 Minimum quantity.

Permit imprint mailings must consist of a minimum of 200 pieces or 50 pounds, except as provided in 145.52. Minimum quantities of mail necessary to mail at the nonpresort ZIP+4 rate, or at any of the First-Class presort rates, the fourth-class bulk zone rate, the special fourth-class presort rate and the bulk bound printed matter rates, are higher. See the appropriate chapter for the class of mail in question.

145.52 Exceptions to minimum Quantities.

A mailing consisting of less than the required minimum will be accepted by the Postal Service, if one of the following requirements is met:

a. First-Class Mail. An occasional mailing for a mailer whose total daily mailings are not much more than 200 pieces but who, to cooperate with the post office, presents a portion of his mailings early in the day.

b. All Classes of Mail. A large mailing which extends over two or more consecutive days and the deposit, made to complete the mailing, is less than the minimum.

Note: In order to be considered an exception, the mailer must include an explanation on Form 3602, Statement of Mailing With Permit Imprints.

145.53 Preparation of Mailing.

The mailer must arrange all pieces with the address side facing the same way. It is recommended that the mailer separate the pieces to the finest extent possible in the manner prescribed in 360, 460, 660, and 724, and 760. Each class of mail must be presented with a separate Form 3602, Statement of Mailing with Permit Imprints, or Form 3605, Statement of Mailing—Bulk Zone Rates. Pieces in fourth-class mailings on which postage is paid at different zone rates must be separated by zone.

145.54 Place of Mailing.

Mail must be deposited at the post office which issued the permit or at a station or branch designated by the postmaster. Permit imprint mail will be accepted at the main post office or at classified stations and branches where there is a separation of financial and mailhandling activities.

145.55 Mailing Statement.

A Form 3602 or 3605 must be prepared and signed by the mailer for each mailing. The statement must be prepared by typewriter, ink, or indelible pencil to show the mailer's address, permit number, class of mail, number of pieces in the mailing, weight of a single piece, and any additional information required by the respective mailing statements. If a receipt is desired, the mailer must present a duplicate copy of Form 3602 or 3605, which will be initialed by the accepting employee after verification and returned to the mailer.

145.56 Prepayment of Postage Required.

The mailer must pay for each mailing when it is presented at the post office, or make an advance deposit sufficient to cover more than one mailing. Payments for postage or deposits must be made at points designated by the postmaster. These payments will not be accepted by employees handling the mail. When the deposit becomes leas than enough to pay for an entire mailing, an additional amount must be deposited before any mailings are made. Credit for postage is not allowed. Postage may not be paid partly in money and partly by postage stamps, except as provided in 681.221d. Whenever the computation of postage results in a fraction of a cent in the total, the total must be rounded

What is claimed is:

1. A system for processing mail, comprising:

an electronic postage metering device having a first descending register, an unsecured interface device in communication with said electronic postage metering device, said interface device having means for communicating with a plurality of devices and a second descending register for tracking the data stored in said first descending register, a printer in communication with said interface device, said printer having means for printing postage information, and a funds center, said interface device being in selective communication with said funds center, said interface including means for providing communication between said funds center and said electronic postage metering device whereby said first descending register can be refreshed.

2. The system of claim 1 including means for processing mail in communication with said interface device and having means for providing mailing information to said interface device.

3. The system of claim 2 wherein said means for printing postage information includes means for printing on a statement sheet.

* * * * *